US008413616B2

(12) United States Patent
Bergquist

(10) Patent No.: US 8,413,616 B2
(45) Date of Patent: Apr. 9, 2013

(54) ARRANGEMENT RELATED TO A MOTOR-DRIVEN TOOL

(75) Inventor: Oskar Bergquist, Huskvarna (SE)

(73) Assignee: Husqvarna AB, Huskvarna (SE)

( * ) Notice: Subject to any disclaimer, the term of this patent is extended or adjusted under 35 U.S.C. 154(b) by 0 days.

(21) Appl. No.: 12/516,526

(22) PCT Filed: Nov. 24, 2006

(86) PCT No.: PCT/SE2006/001336

§ 371 (c)(1),
(2), (4) Date: Sep. 11, 2009

(87) PCT Pub. No.: WO2008/063106

PCT Pub. Date: May 29, 2008

(65) Prior Publication Data

US 2010/0059000 A1 Mar. 11, 2010

(51) Int. Cl.
*F01P 5/06* (2006.01)

(52) U.S. Cl. ..... 123/41.65; 123/41.7; 123/41.56; 123/41.63

(58) Field of Classification Search ..... 123/41.65, 123/41.7, 195 C, 41.58, 41.66, 41.56, 41.63; 180/68.1, 219, 230, 227, 217, 229, 68.4, 180/312, 294, 68.3, 908; 474/144, 93, 146, 474/43; 74/606 A See application file for complete search history.

(56) References Cited

U.S. PATENT DOCUMENTS

| | | | | |
|---|---|---|---|---|
| 4,497,285 | A * | 2/1985 | Kondo | 123/41.65 |
| 4,537,160 | A * | 8/1985 | Shirai | 123/41.58 |
| 5,231,956 | A | 8/1993 | Lux | |
| 5,526,777 | A * | 6/1996 | Taomo et al. | 123/41.65 |
| 5,542,380 | A | 8/1996 | Chatten | |
| 5,720,243 | A * | 2/1998 | Stegemyr et al. | 123/198 E |
| 6,314,922 | B1 * | 11/2001 | Zimmermann et al. | 123/41.65 |
| 6,494,180 | B1 * | 12/2002 | Schlossarczyk | 123/392 |
| 6,868,821 | B2 | 3/2005 | Maier | |
| 2004/0083988 | A1 * | 5/2004 | Maier et al. | 123/41.7 |

* cited by examiner

*Primary Examiner* — Lindsay Low
*Assistant Examiner* — Tea Holbrook
(74) *Attorney, Agent, or Firm* — Novak Druce Connolly Bove + Quigg LLP

(57) ABSTRACT

An arrangement for cleaning of intake air for an air-cooled internal combustion engine of a motor-driven tool, such as a chain saw. The arrangement includes an air conductor surrounding a fan wheel arranged to propel intake air around an axis of the fan wheel. An inner wall of the air conductor is arranged for guiding air propelled by the fan wheel. An air nozzle for cleaning of intake air is arranged on the inner wall of the air conductor radially close to said fan wheel. The air nozzle serves as a passage way for providing cleaned intake air from the fan wheel to the engine of the motor-driven tool, wherein the air nozzle and the air conductor are manufactured in one piece.

13 Claims, 5 Drawing Sheets

ARRANGEMENT RELATED TO A MOTOR-DRIVEN TOOL

TECHNICAL FIELD

The present invention relates to an arrangement related to a motor-driven tool, such as a chain saw, hedge trimmer or the like. More particularly, it relates to an arrangement for cleaning intake air for an internal combustion engine intended for such a motor-driven tool.

BACKGROUND

Many types of working tools, such as chain saws, hedge trimmers, grass trimmers and other cutting machines operate in dusty environments. Also, the tools themselves are supplying surrounding air with lots of particles from the material that is tooled, e.g. wood, concrete, grass etc.

Traditionally, airfilters are used for cleaning intake air to the engine. However, these airfilters will soon be stopped up by larger or smaller particles and must therefore be exchanged and cleaned often, e.g. for a professional lumberjack working all day with a chain saw, typically once a day.

In order to reduce the need for maintenance of the air filter, it is desirable to clean the intake air before it reaches the air filter of the engine. Such cleaning of intake air can be achieved by centrifugal cleaning. For this reason, different types of deflection cleaners have been designed. In several cases deflection takes place at the inlet of a duct or similar, which debouches in a carburettor area, where the air filter and the carburettor is situated.

U.S. Pat. Nos. 4,716,860, 4,841,920, WO97/44582 and U.S. Pat. No. 5,720,243 show examples of such arrangements for cleaning of intake air. The arrangements shown in these documents utilize a fan wheel as a centrifuge for separating particles from the intake air, and a duct or an air nozzle with an inlet placed close to the fan wheel and an outlet placed near the air filter of the engine. As is shown in e.g. U.S. Pat. No. 5,720,243, the inlet of the air nozzle is placed adjacent to the fan wheel with a distance to the periphery of a surrounding fan housing. Since particles are thrown against the periphery of the fan housing due to the centrigual force, and since the inlet of the duct or air nozzle is placed adjacent to the fan wheel with a distance to the fan housing, the air that flows into the inlet of the air nozzle is substantially free from particles.

The prior art arrangements described above are relatively expensive to produce and to assemble in a hand-held motor-driven tool, and there is always a desire to produce and assemble tools as cost-effective as possible. Also, in the prior art arrangements there is a risk that a small opening or slot will exist between the fan housing and the air nozzle, after the air nozzle and the fan housing has been assembled, through which opening air may slip through. This may result in a pressure fall and turbulence in the air which would result in a less effective cleaning of the intake air. Therefore, there is a need to provide a motor-driven tool with an arrangement for cleaning of intake air which is effective in cleaning the intake air and at the same time cost-effective to produce and assemble.

SUMMARY

An object of the invention is to provide an arrangement for cleaning of intake air for an internal combustion engine of a motor-driven tool, which arrangement is cost-effective to produce and to assemble onto a tool, and which can filter out a high degree of particles.

This is achieved with an arrangement according to the preamble of claim 1, in which the air nozzle and the air conductor are manufactured in one piece. Thereby, the air nozzle and the air conductor can be manufactured in one step instead of in separate steps, and the manufactured air conductor including the air nozzle can be assembled as one unit onto a crankcase of the tool. This results in a quick and thereby cost-effective manufacturing of the arrangement and assembling of the arrangement onto a crankcase of the tool. Another advantage is that an airtight seal is achieved between the air nozzle and the air conductor such that there is no risk of air slipping through close to the opening of the air nozzle, between a wall of the air nozzle and the air conductor.

Since the passage way of the air nozzle is created from surfaces of the air conductor, the air nozzle and also the tool's crankcase on which the air conductor including the air nozzle is arranged according to claim 2, it is possible to easily and reliably assemble the air conductor including the air nozzle onto the crankcase.

According to claim 3, an end part of a wall of the air nozzle that is arranged close to the inlet of the air nozzle, is formed such that it is directed towards the fan wheel. Thereby, particles that are blown by the fan wheel close to the inlet may be hindered to enter the inlet due to the shape of the wall, which results in a better cleaning of the intake air.

By arranging a protrusion on the tool's crankcase, which protrusion defines a wall of the passage way of the air nozzle according to claim 4, the inlet of the air nozzle will be spaced from the crankcase, thereby being able to filter out particles in an even higher degree. Another advantage with such an arrangement is that the air conductor including the air nozzle comes to rest on the protrusion, when assembled onto the crankcase. Thereby, the air conductor including the air nozzle can be reliably assembled in one step onto the crankcase without having to use screws or similar attachment means, which results in an even quicker and more cost-effective assembling of the tool. This assembling will be especially reliable if a part or parts of the tool surrounding the air conductor, e.g. a starter of the tool, is arranged close to the air conductor in such a way that the air conductor including the air nozzle is pushed onto the crankcase by the surrounding part of the tool.

Also, the protrusion can be manufactured as an integral part of the crankcase, as mentioned in claim 5. By manufacturing the protrusion as an integral part of the crankcase, no separate step of assembling such a protrusion to the crankcase has to be taken, which means a cost-effective manufacture of the protrusion.

By arranging the protrusion such that a wall of protrusion, which wall defines the passage way of the air nozzle, is rounded in a direction towards the opening of the crankcase, as claimed in claim 6, a flow of air with low turbulence is achieved in the passage way, which results in a high flow of the air flowing through the passage way.

By arranging the protrusion with a recess according to claim 7, a stable manufacturing process of the crankcase will be achieved. Also, a thin material thickness, which is the result of producing the protrusion with a recess, results in a short manufacturing process when the crankcase is manufactured by injection moulding.

By manufacturing the air nozzle and the air conductor in an injection moulding process as mentioned in claim 8, a quick and cost-effective manufacturing of the parts can be achieved.

BRIEF DESCRIPTION OF THE DRAWINGS

The invention will in the following be described in more detail with reference to the enclosed drawings, in which.

DESCRIPTION OF EMBODIMENTS

Figure 1:
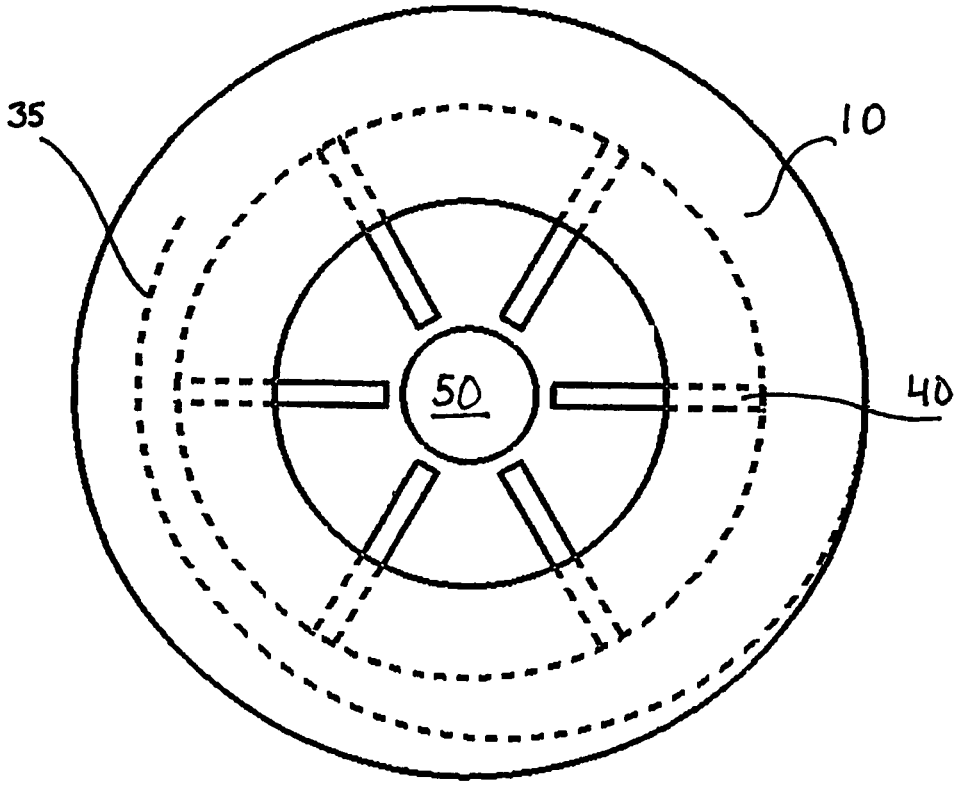
FIG. 1 schematically shows a front view of a fan wheel and an air conductor that could be inserted in a crankcase of a tool in which the arrangement of the invention can be used.
Figure 2:
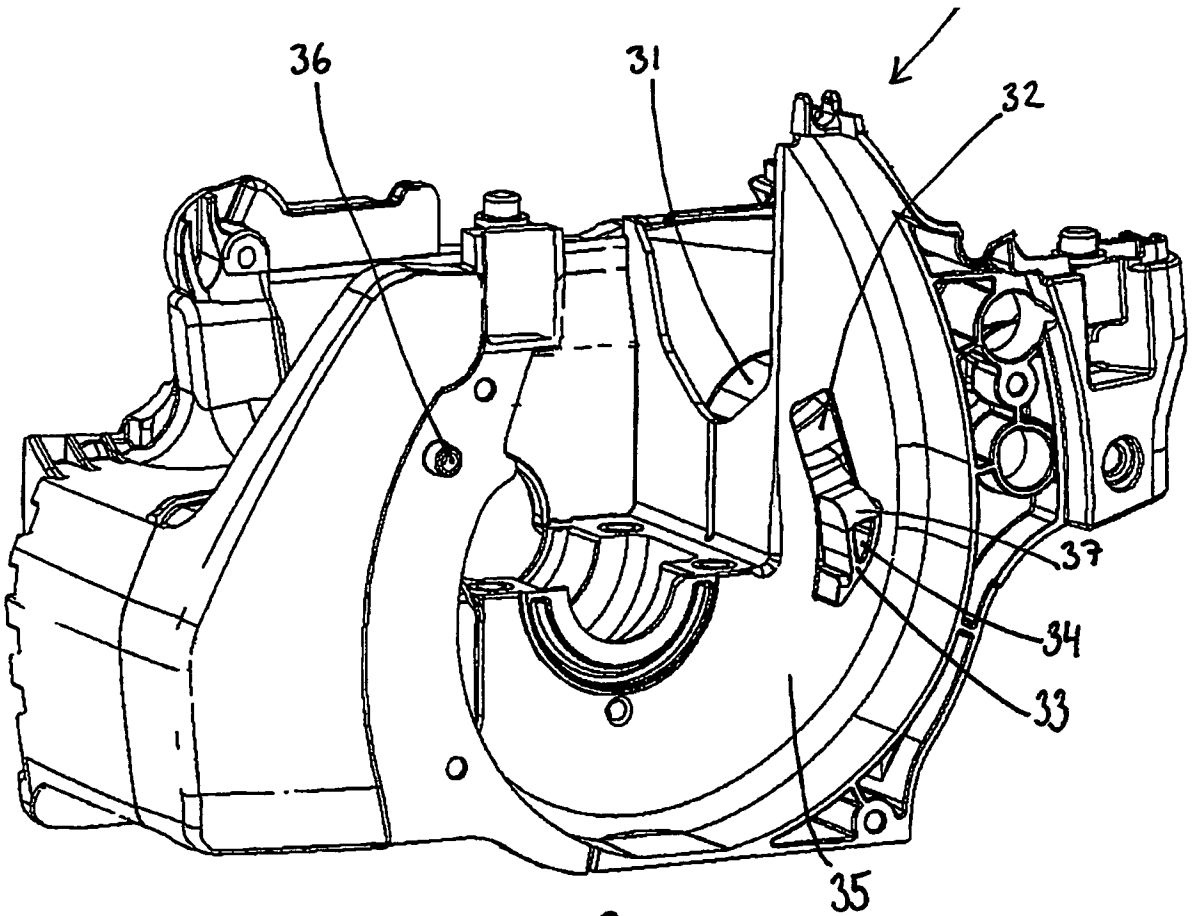
FIG. 2 shows schematically a perspective view of a crankcase.

FIG. 2 shows a crankcase 30 of a chain saw, which incorporates a combustion engine. The crankcase 30 has a recess 35 in which a fan wheel 40 (FIG. 1) is placed. The fan wheel is assembled on an axle 50, usually the engine's crankshaft. The fan wheel 40 is arranged to be propelled around the axle such that air from the environment around the tool is taken into the fan wheel and propelled into different parts of the tool. This intake air propelled by the fan wheel is used for cooling of parts of the tool and as combustion air for the engine. A wall of the recess of 35 of the crankcase 30 which surrounds the periphery of the fan wheel 40 is preferably arranged such that the distance between the periphery of the fan wheel 40 and the wall is increasing in a direction to an area where air exits the wheel (see FIG. 1).

The fan wheel 40 is also covered by an air conductor 10 arranged on the crankcase 30, in such a way that the recess 35 of the crankcase and the air conductor 10 houses the fan wheel. In FIG. 1, which shows a front view of the fan wheel and the air conductor, the air conductor 10 partly hides the fan wheel 40. Although, in other embodiments, the air conductor may be more narrow, such that it does not hide the fan wheel 40. The propagation of the air propelled by the fan wheel is limited by the wall of the recess 35 in the crankcase 30 and by the inner surface 11 of the air conductor 10 (see FIG. 3).

Since the intake air contains particles from the surrounding environment, the part of the intake air that is used as combustion air for the engine, for example directed to a carburettor of the engine, has to be cleaned from particles before it reaches the carburettor. For this reason, there is an air filter (not shown) that the intake air is taken through after leaving the fan wheel and before it reaches the carburettor.

The arrangement of the invention also has an air nozzle 20 (see FIG. 3) arranged on the air conductor 10, which air nozzle 20 serves as a passage way for combustion air, i.e. air used for the engine, which air is taken to the air filter. The air nozzle 20 together with the air conductor 10 functions as an arrangement according to the invention for cleaning of intake air, before the intake air reaches the air filter. Thereby, the air filter does not have to be exchanged as often as if the intake air is taken directly to the air filter, without cleaning.

The air nozzle 20 has an inlet 21. By arranging the air nozzle 20 on the air conductor 10 such that the inlet 21 is spaced from the periphery of the air conductor 10, (see e.g. FIGS. 3 and 5) only air that has a low concentration of particles will enter the inlet. I.e. the inlet 21 is placed such that only air with a low concentration of particles will enter the inlet 21 of the air nozzle. For this reason, the inlet 21 is also preferably arranged adjacent to the periphery of the fan wheel. For the same reason, the inlet is also preferably arranged spaced apart from the recess 35 of the crankcase 30, although the inlet 21 might also be arranged without a spacing to the recess 35 of the crankcase.

The air nozzle 20 also has an outlet 22 connected to an opening 32 of the crankcase 30, which opening 32 is connected to a space close to the engine in which the air filter is situated, e.g. an inner space 31 of the tool. Due to the centrifugal force, the particles in the intake air will be propelled close to the periphery of the air conductor 10 and the wall of the crankcase recess 35. By arranging the inlet of the air nozzle spaced apart from the periphery of the air conductor, the air that will flow into the inlet 21 will have a low concentration of particles.

According to the invention, the air nozzle 20 is arranged on the inner wall 11 of the air conductor 10, and the air conductor 10 and the air nozzle 20 are manufactured in one piece. Thereby, the manufacturing process of the air conductor and the air nozzle would be simpler, and thereby cost-effective, compared to manufacturing two separate pieces. In addition, the assembling procedure of the air conductor including the air nozzle onto a crankcase of the tool would be quick since it will comprise only one step. Another advantage with the invention is that there is no risk that air may flow through a possible small opening between an air conductor and an air nozzle, which opening may occur when assembling an air conductor and an air nozzle manufactured as two separate parts. Such an opening may result in a pressure fall in the passage way of the air nozzle and that air comprising particles may enter the air nozzle.

The piece is made of a material which is easy to manufacture and form during the manufacturing process but rigid and durable in normal conditions, for example rigid plastic, manufactured by a plastic moulding process, such as injection moulding.

As shown in e.g. FIG. 2, the crankcase 30 further comprises a protrusion 33 arranged immediately below an opening 32 of the crankcase, which opening is connected to the inner space 31 of the tool. The protrusion 33 defines a wall of the passage way created by the air nozzle (see FIG. 5). Thanks to the protrusion 33, only intake air, which is propelled spaced from the bottom of the recess 35, will be led into the inlet 21. Also, due to the protrusion 33 defining the inner wall of the passage way of the air nozzle, the air conductor with the air nozzle can be assembled in one step onto the crankcase and rest on the protrusion and thereby stay in place on the crankcase 30. By arranging the protrusion 33 on the recess of the crankcase, the air conductor 10 including the air nozzle 20 can be securely arranged on the crankcase 30 without an attachment element needing a tool for the attachment procedure, such as a screw. Also, since no screws or other similar attachment elements are used for the assembling of the air conductor including the air nozzle onto the crankcase, consequently no tool has to be used for disassembling the air conductor including the air nozzle.

Figure 3:
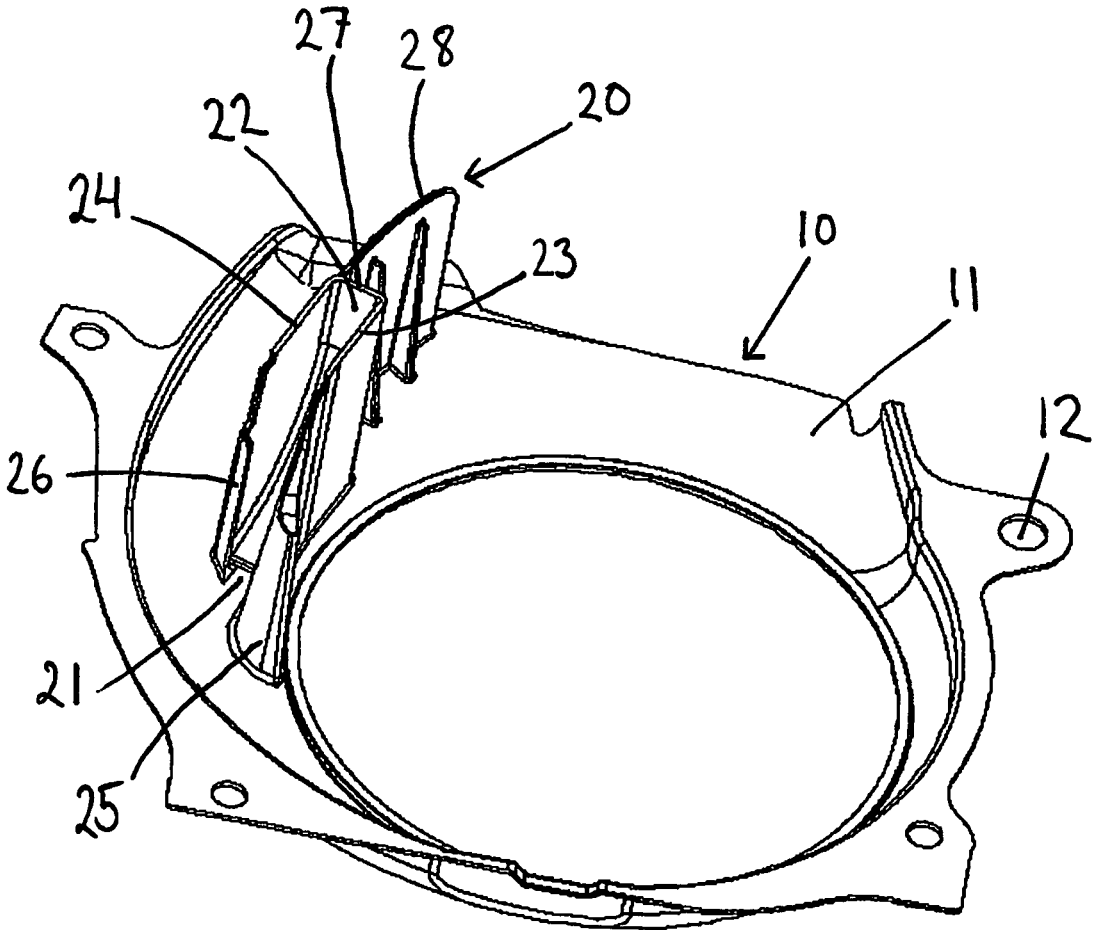
FIG. 3 shows schematically a perspective view of an air conductor and an air nozzle according to the invention.
Figure 4:
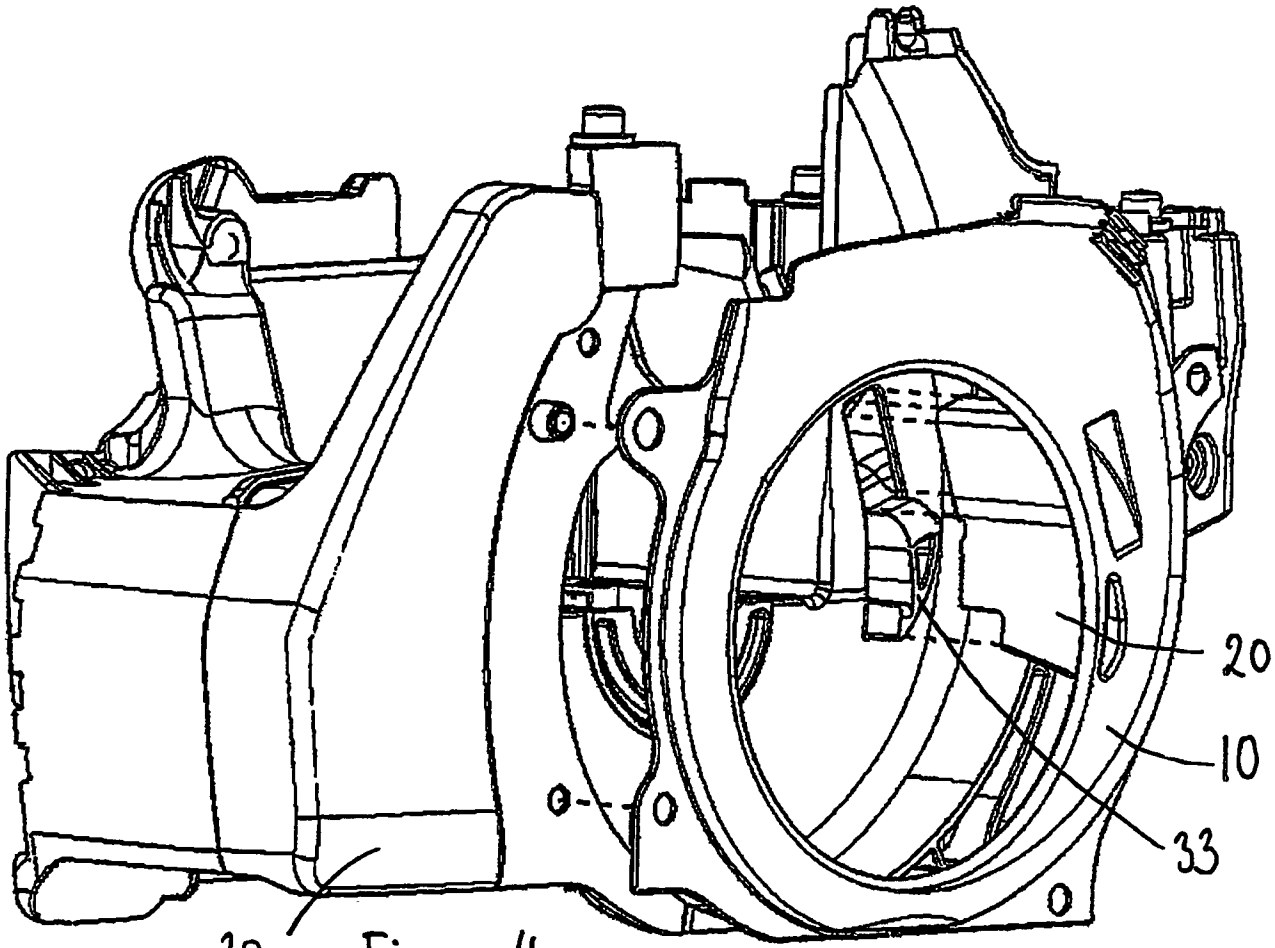
FIG. 4 illustrates an exploded view in perspective of the crankcase of FIG. 2 and the air conductor including the air nozzle of FIG. 3.

In the FIGS. 2-4, an exemplary embodiment of the attachment used for attaching the air conductor 10 including the air nozzle 20 to the crankcase 30 is shown. Here, the air conductor 10 is arranged on the crankcase 30 by the air nozzle 20 resting on the protrusion 33 and by inserting a protrusion 36 of the crankcase into a hole 12 of the air conductor 10. The air conductor 10 including the air nozzle 20 is then kept in place reliably. This is also achieved due to an arrangement of the tool surrounding the air conductor, e.g. a starter of the tool, pushing the air conductor and the air nozzle towards the crankcase.

The protrusion 33 may, according to an embodiment, have a substantially centrally arranged cavity 34. Thereby, material will be spared when manufacturing the crankcase and the protrusion. Also, the manufacturing process will be shorter and more stable. The crankcase 30 is manufactured from a mouldable material, which is rigid and durable in normal conditions, for example rigid plastic. It may be manufactured by for example injection moulding. In an alternative embodiment, the crankcase 30 is manufactured from metal in e.g. a die cast procedure.

Figure 5:
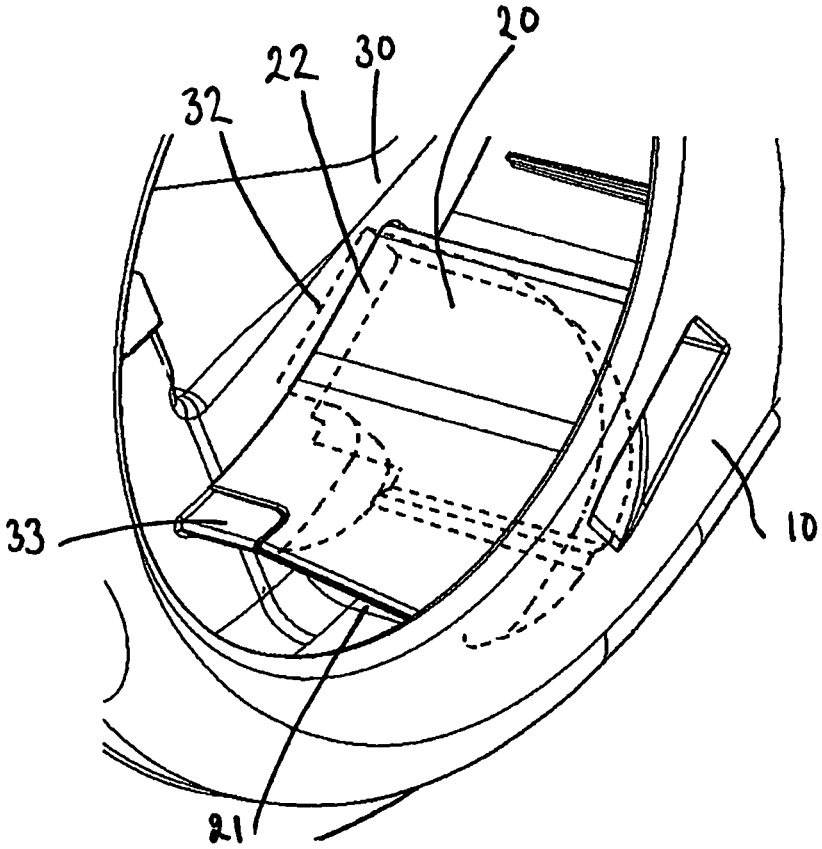
FIG. 5 illustrates a close-up view of a part of FIG. 4 when the air conductor including the air nozzle is assembled onto the crankcase.

A wall 37 of the protrusion 33, which wall 37 defines the passage way for air taken through the air nozzle 20, is rounded (see FIGS. 2 and 5). The rounding of wall 37 starts close to the inlet 21 of the air nozzle 20 and ends close to the outlet 22 of the air nozzle. Thereby, there will be less air turbulence compared to if the protrusion 33 would have two perpendicularly arranged walls connected by a corner, or if such a wall 37 has a small rounding starting and ending close to such a corner.

FIG. 3 shows an embodiment of the arrangement according to the invention with the air conductor 10 and the air nozzle 20 arranged in one piece. The air nozzle 20 in this embodiment has a first wall 23 and a second wall 24 extending substantially perpendicular to the inner wall 11 of the air conductor 10. The first and the second walls are connected by a third wall 27. The first wall 23 being arranged between the fan wheel 40 and the second wall 24. The second wall also has a flange 28 for directing air intended for cooling of the tool, which flange 28 extends from the third wall 27 in a direction away from the inlet 21. The first wall 23 and the second wall 24 each has a main part extending substantially tangential to the fan wheel. The first wall 23 and the second wall 24 each has end parts 25, 26 close to the inlet (21), which end parts are directed towards the fan wheel.

Although the arrangement of the invention has mainly been described for a chain saw, it might as well be used for any other motor-driven tool having an internal combustion engine, such as a clearing saw, a brush cutter, a hedge trimmer, a grass trimmer or a lawnmower.

In the drawings and specification, there have been disclosed preferred embodiments and examples of the invention and, although specific terms are employed, they are used in a generic and descriptive sense only and not for the purpose of limitation, the scope of the invention being set forth in the following claims.

The invention claimed is:

1. An arrangement for cleaning of intake air for an air-cooled internal combustion engine, the arrangement comprising:

an air conductor surrounding a fan wheel, an inner wall of the air conductor being arranged for guiding air propelled by the fan wheel;

an air nozzle for cleaning of the intake air, arranged on the inner wall of the air conductor radially close to said fan wheel, the air nozzle serving as a passage way for providing cleaned intake air from the fan wheel to the engine;

wherein the air nozzle and the air conductor are manufactured in one piece; and, wherein the air nozzle has a first wall and a second wall extending substantially perpendicular to the inner wall of the air conductor, the first wall being arranged between the fan wheel and the second wall, the second wall having an end part proximate an inlet of the nozzle, wherein the end part is directed towards the fan wheel.

2. The arrangement according to claim 1, wherein the air conductor including the air nozzle is arranged on a crankcase, wherein the air nozzle has an inlet arranged such that it receives intake air with a low concentration of particles, and an outlet through which cleaned air is lead to the engine, and wherein the air nozzle, the air conductor and a surface of the crankcase define the passage way from the inlet to the outlet.

3. The arrangement according to claim 1, wherein the air conductor including the air nozzle is arranged on the crankcase, and wherein the crankcase further comprises a protrusion arranged immediately below an opening of the crankcase, wherein the opening leads to the engine, an outlet of the air nozzle leading to the opening of the crankcase, said protrusion defining a wall of the passage way of the air nozzle.

4. The arrangement according to claim 3, wherein the protrusion is manufactured as an integral part of the crankcase.

5. The arrangement according to claim 3, wherein the wall of the passage way of the air nozzle defined by the protrusion is rounded in a direction towards the opening of the crankcase.

6. The arrangement according to claim 3, wherein the protrusion has a substantially centrally arranged cavity.

7. The arrangement according to claim 1, wherein the air conductor including the air nozzle are manufactured by injection moulding.

8. The arrangement according to claim 1, wherein the engine is a component of a motor-driven tool.

9. An air conductor configured to surround an air intake fan wheel of internal combustion engine, the air conductor comprising:

an inner wall; and, an air nozzle affixed to the inner wall, the air nozzle serving as a passage way for providing cleaned intake air from the fan wheel to the engine;

the air nozzle having a first wall and a second wall extending substantially perpendicular to the inner wall of the air conductor, the first wall being arranged between the fan wheel and the second wall, the second wall having an end part proximate an inlet, wherein the end part is directed towards the fan wheel.

10. The air conductor as recited in claim 9, wherein the first wall and the second wall are substantially parallel to each other.

11. The air conductor as recited in claim 9, wherein the first wall and the second wall are curvilinear in shape and are formed at different radiuses from a center point of the fan wheel and being formed such that there is a radial distance between the first wall and the second wall.

12. The air conductor as recited in claim 9, wherein air nozzle receives air from the fan wheel and redirects the air to an opening in a crankcase of an engine.

13. The air conductor as recited in claim 9, wherein the air nozzle is configured to rest on a protrusion of a crankcase of the engine.

* * * * *